US007270564B1

(12) United States Patent
Boischio

(10) Patent No.: US 7,270,564 B1
(45) Date of Patent: Sep. 18, 2007

(54) CONNECTOR FOR CONNECTING ELECTRICAL WIRES TO ELECTRONIC BOARDS IN DOMOTIC NETWORKS

(75) Inventor: Ido Boischio, Padua (IT)

(73) Assignee: Inarca S.p.A., Vigodarzere (IT)

( * ) Notice: Subject to any disclaimer, the term of this patent is extended or adjusted under 35 U.S.C. 154(b) by 0 days.

(21) Appl. No.: 11/606,041

(22) Filed: Nov. 30, 2006

(30) Foreign Application Priority Data

Dec. 23, 2005 (IT) ..... PD20050100 U

(51) Int. Cl.
*H01R 4/24* (2006.01)

(52) U.S. Cl. ..... 439/417; 439/682; 439/860

(58) Field of Classification Search ..... 439/694, 439/417, 695, 682, 857, 860
See application file for complete search history.

(56) References Cited

U.S. PATENT DOCUMENTS 5,588,869 A * 12/1996 Jensen et al. ..... 439/417
5,641,302 A * 6/1997 Adams ..... 439/417
5,860,829 A * 1/1999 Hower et al. ..... 439/417
5,989,057 A * 11/1999 Gerke et al. ..... 439/417
6,299,475 B1 * 10/2001 Huspeni et al. ..... 439/412
6,302,723 B1 * 10/2001 Baum et al. ..... 439/412
6,406,324 B1 6/2002 Duesterhoeft et al.
2005/0227529 A1 10/2005 Mrakovich

FOREIGN PATENT DOCUMENTS

EP 0 489 549 A2 6/1992
WO 99/04455 A 1/1999

* cited by examiner

*Primary Examiner*—Michael C. Zarroli
(74) *Attorney, Agent, or Firm*—Modiano & Associati; Albert Josif; Daniel J. O'Byrne

(57) ABSTRACT

An electrical connector for transmitting low-voltage signals among electronic units in domotic networks comprising a box-like connection shell, forming internally at least one receptacle for a corresponding electrical terminal; the terminal constituted by two parts, a first part for fixing to one or more electrical wires and a second part for reversible coupling to a connection pin to be coupled to an electronic board. The first part comprises a plate on which a through hole is formed centrally, within the plate. The through hole is constituted by a first portion for insertion of the electrical wires and a second portion for connection to wires, which opens onto the first portion and has two converging internal edges for stripping and contact with the wires. The second part of the terminal is constituted by two converging wings, protruding from a connection bridge.

15 Claims, 4 Drawing Sheets

CONNECTOR FOR CONNECTING ELECTRICAL WIRES TO ELECTRONIC BOARDS IN DOMOTIC NETWORKS

The present invention relates to an electrical connector for transmitting low-voltage signals between electronic units or for transmitting low power levels, particularly useful for the wiring of domotic networks.

BACKGROUND OF THE INVENTION

As is known, electronic technology is becoming increasingly widespread also in typical electromechanical sectors such as electrical household appliances: electronics is in fact used increasingly to control and optimize the operation of the electromechanical components of the household appliance and to manage adequately its functionalities.

In the home, electronics even manages and controls electrical, heating and water systems.

The science that studies the interaction between electronics and the home environment is known as domotics.

The expression "domotic applications" typically refers to home applications which are controlled electronically by one or more electronic central units.

In order to provide domotic applications, it is necessary to provide wiring in order to connect the central electronic unit to the peripheral units to be controlled; in practice, it is necessary to provide domotic networks.

In domotic networks, the wiring must meet certain particular requirements.

The connections among the various peripheral units and the central electronic units in fact must be easily removable, since these networks are evolving continuously: it is in fact necessary to change peripherals or to add some according to requirements.

The wiring must therefore be easy to provide and remove, and it must be possible to mostly isolate it from the environment in order to avoid problems with dirt, which makes the wiring ineffective, and most of all problems with humidity, which is particularly felt in spaces such as the kitchen, bathroom and balcony.

SUMMARY OF THE INVENTION

The aim of the present invention is to provide an electrical connector for transmitting low-voltage signals among electronic units or for transmitting low power levels which is particularly adapted for wiring domotic networks.

Within this aim, an object of the present invention is to provide an electrical connector for transmitting low-voltage signals among electronic units or for transmitting low power levels which is structurally simple.

Another object of the present invention is to provide an electrical connector for transmitting low-voltage signals among electronic units or for transmitting low power levels which can be disconnected easily from the user device to which it is connected.

Another object of the present invention is to provide an electrical connector for transmitting low-voltage signals among electronic units or for transmitting low power levels, particularly for wiring domotic networks, which can be manufactured with known systems and technologies.

This aim and these and other objects, which will become better apparent hereinafter, are achieved by an electrical connector for transmitting low-voltage signals among electronic units or for transmitting low power levels particularly for wiring domotic networks, characterized in that it comprises a box-like connection shell, which is shaped like a parallelepiped and forms internally at least one receptacle for a corresponding electrical terminal, said at least one receptacle having an opening which is formed on the connection face of said box-like connection shell and a transverse access hole which is formed on a face which is perpendicular to said connection face and is adapted for the passage of the end of at least one electrical wire for connection to said electrical terminal, said electrical terminal being constituted by two parts, a first part for fixing to the at least one electrical wire and a second part for reversible coupling to a connection pin, said first part being constituted by a laminar body which is folded so as to form a transverse cross-section which has a quadrangular profile in which at least one side is constituted by a plate on which a through hole is formed centrally, said hole being delimited completely within said plate and being in turn constituted by two portions, a first portion for the insertion of the at least one electrical wire and a second portion for connection to said at least one wire, which opens onto said first portion and has two internal edges which at least partially converge for stripping and contact with said at least one electrical wire, said second part being constituted by two wings which at least partially converge and protrude from a bridge for connection to one end of said laminar body, said bridge protruding in the direction of insertion of the wire in said through hole, said two wings protruding substantially in the same direction as said plate, the positioning of said at least one electrical wire being delimited between an abutment formed on said box-like connection shell and said converging internal edges of said through hole of the terminal.

BRIEF DESCRIPTION OF THE DRAWINGS

Further characteristics and advantages of the invention will become better apparent from the following detailed description of a preferred but not exclusive embodiment thereof, illustrated by way of non-limiting example in the accompanying drawings, wherein.

DESCRIPTION OF THE PREFERRED EMBODIMENTS

Figure 1:
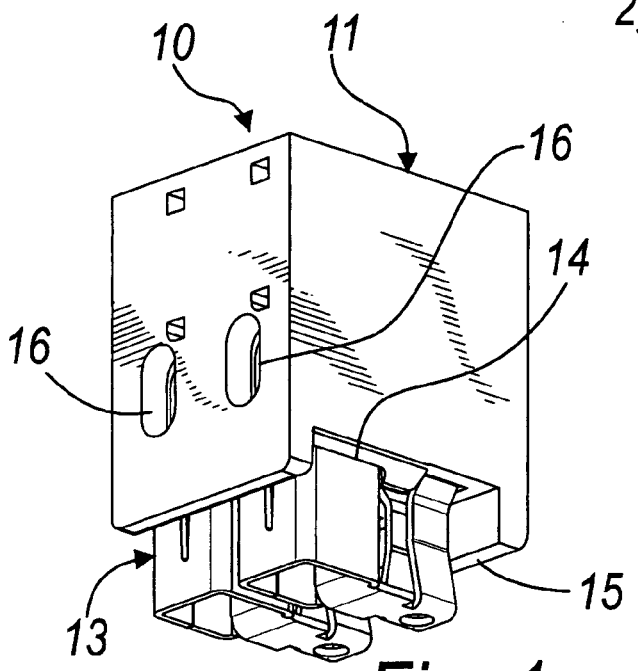
FIG. 1 is a perspective view of a connector according to the invention, in which the electrical terminals are partially external to the receptacles so as to match the step for insertion and crimping of the wires.
Figure 2:
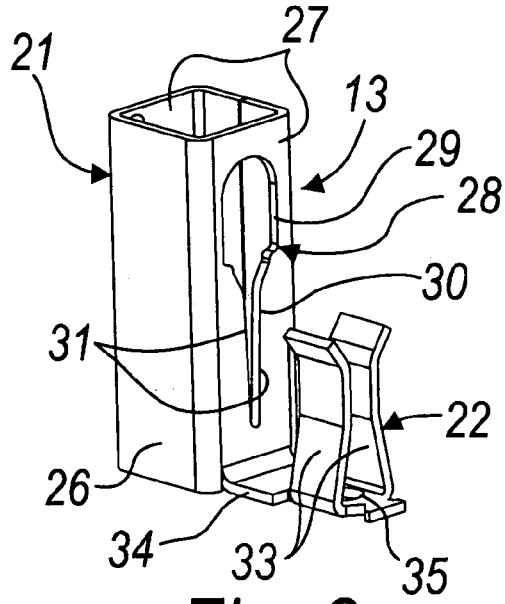
FIG. 2 is a perspective view of an electrical terminal of a connector according to the invention.
Figure 3:
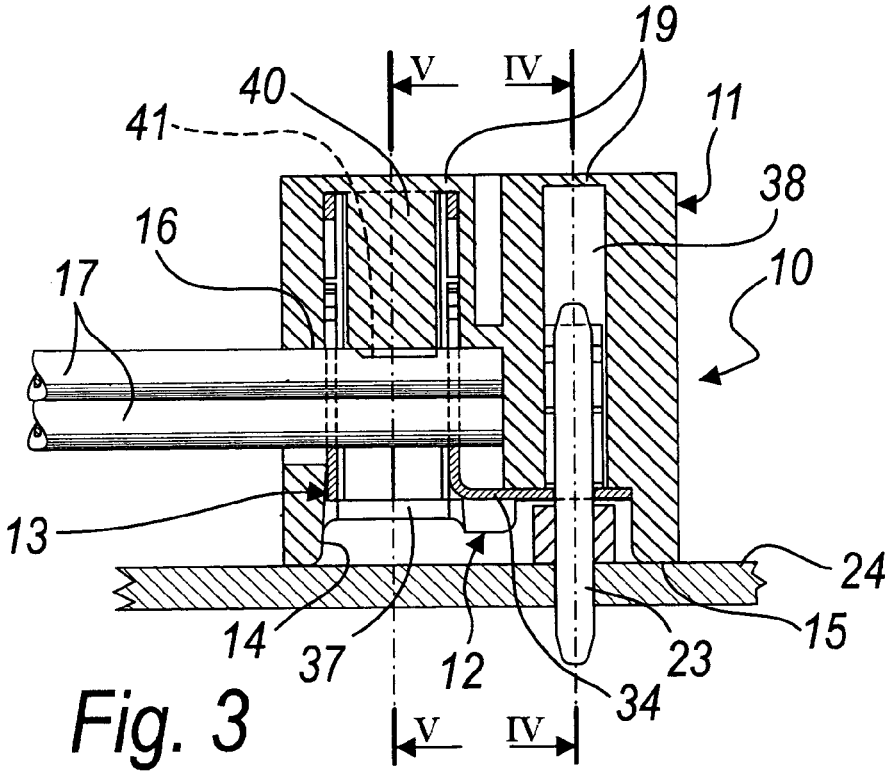
FIG. 3 is a sectional view of a connector, taken along the line III-III of FIG. 6.

It is noted that anything found to be already known during the patenting process is understood not to be claimed and to be the subject of a disclaimer.

With reference to the figures, a connector for wiring domotic networks according to the invention is generally designated by the reference numeral 10.

The connector 10 comprises a box-like connection shell 11 which is shaped like a parallelepiped, has a substantially quadrangular cross-section, and forms internally two receptacles 12 for corresponding electrical terminals 13.

Each receptacle 12 has an opening 14 on the connection face 15 of the box-like connection shell 11 and a transverse access hole 16 which is formed on a face which is perpendicular to the connection face 15; the transverse access hole 16 is adapted for the passage of the end of at least one electrical wire 17 for connection to the electrical terminal 13 inserted in the receptacle 12 (two wires 17 are provided in the figures for each transverse access hole 16).

The bottom of each receptacle 12 is completely closed by a closure wall 19 which is monolithic with respect to the rest of the box-like connection shell 11; in practice, the faces of the box-like connection shell 11 are completely closed except for the connection face and the face in which the transverse access holes 16 are provided.

Each electrical terminal 13, formed monolithically by blanking and bending sheet metal, is constituted by two parts, respectively a first part 21 for fixing the electrical wires 17 and a second part 22 for reversible coupling to a connection pin 23, which here is inserted in the appropriately provided hole of an electronic board 24.

The first part 21 is constituted by a laminar body 26, which is folded so as to form a transverse cross-section which has a quadrangular profile in which two sides are constituted by two substantially identical parallel plates 27 which are arranged so as to face each other correspondingly.

A through hole 28 is formed centrally on each plate 27 and is delimited completely by the plate 27.

The through hole 28 in turn is constituted by two portions: a first portion 29 for the insertion of the electrical wires 17 and a second portion 30 for connection to the wires 17; said second portion is open onto the first portion 29 and has two converging internal edges 31 for stripping and contact with the wires 17.

The second part 22 of the electrical terminal 13 is constituted by two partially converging wings 33, which protrude from a bridge 34 for connection to one of the plates 27.

A passage 35 adapted to allow the insertion of the connection pin 23 between the converging wings 33 is provided on the common base of the converging wings 33.

The converging wings 33 protrude substantially in the same direction as the plates 27, so as to match the insertion direction of the electrical terminal 13 in the box-like connection shell 11.

Each receptacle 12 of the corresponding electrical terminal 13 is constituted by two parallel seats, respectively a first seat 37 for accommodating the first part 21 of the electrical terminal 13 and a second seat 38 for accommodating the second part 22 of the terminal 13.

The first and second seats 37 and 38 are divided by a dividing wall 39, which forms on its upper edge the bridge abutment for the bridge 34 for connection between the first and second parts 21 and 22 of the electrical terminal 13.

The dividing wall 39 acts as abutment for the ends of the electrical wires 17.

An anvil body 40 for the electrical wires 17 protrudes from the bottom of the first seat 37 toward the opening 14; when the connector is assembled completely, the ends of the electrical wires 17 in fact pass through the secondary opening 16 and the through holes 28 of the plates 27 until they abut against the dividing wall 39.

Each terminal 13, during the assembly step, is partially external to the respective receptacle 12; in particular, it is inserted to such an extent that the first portions 29 of the through holes 28 of the terminal 13 are arranged so as to match the transverse access hole 16.

During the step of translational motion of the terminal 13 toward the bottom of the respective receptacle 12, the wires 17 are prevented from performing a translational motion by the head 41 of the anvil body 40; the terminal instead continues its stroke, carrying the two converging internal edges 31 formed on the second portion 30 of each through hole 28 of the terminal 13 so as to strip the wires 17.

The shell abutment or anvil body 40 is substantially shaped complementarily with respect to the internal space of the first part 21 of the electrical terminal 13 and the head 41 is concave for the proper positioning of the wires 17.

Once the terminals 13 have been inserted in the receptacles 12 with the wires 17 crimped thereto, the connector 10 is ready to be coupled to the electronic board 24.

Figure 4:
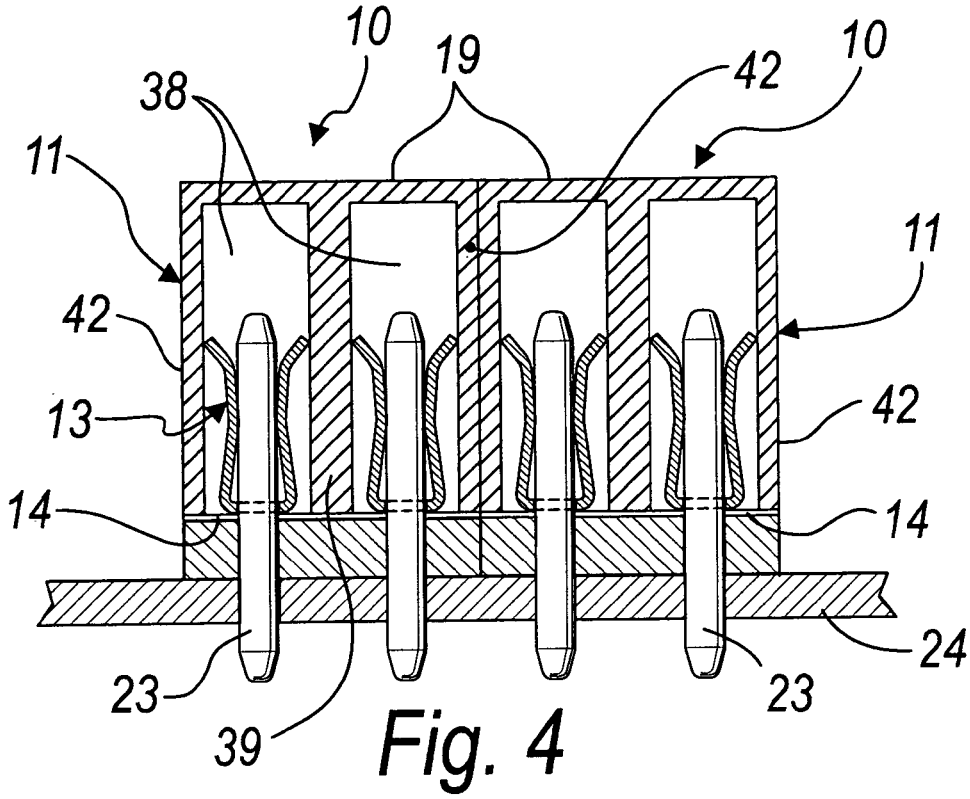
FIG. 4 is a sectional view, taken along the line IV-IV of FIG. 6, of two connectors according to the invention arranged side by side.
Figure 5:
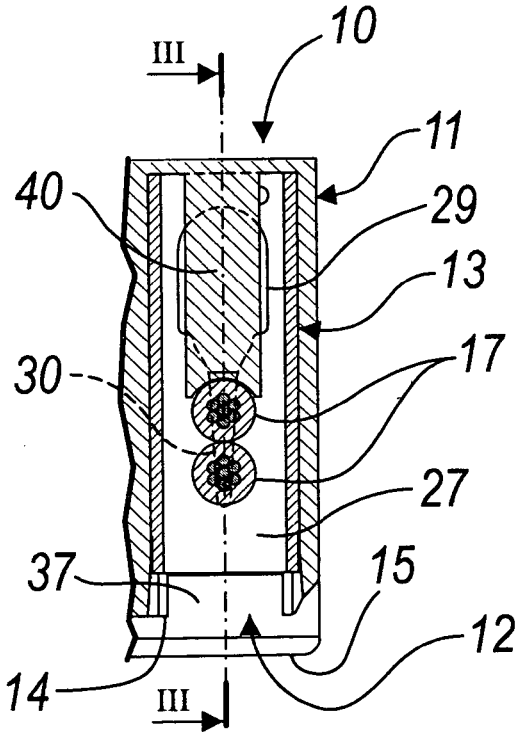
FIG. 5 is a sectional view of a portion of a connector taken along the line V-V of FIG. 3.
Figure 6:
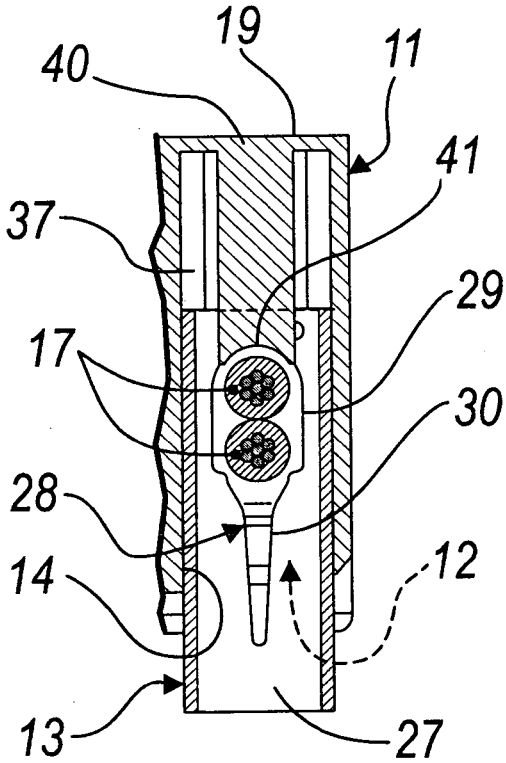
FIG. 6 is a sectional view, similar to FIG. 5, of a connector with an electrical terminal which is partially external to the receptacle, so as to match the step for the insertion and crimping of the wires.
Figure 7:
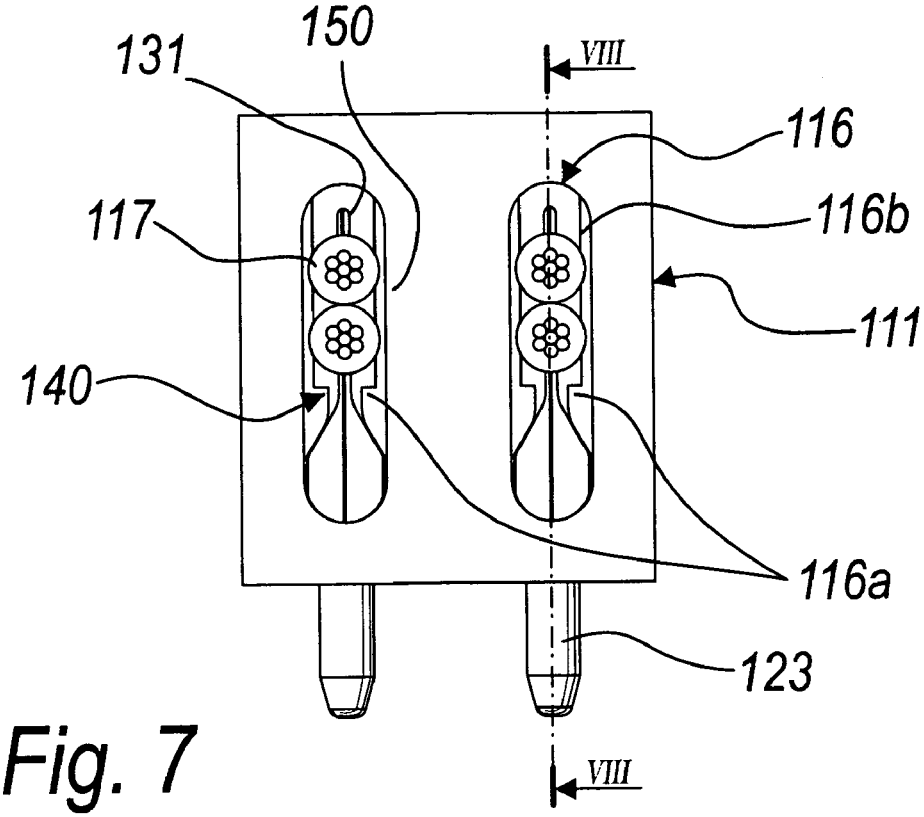
FIG. 7 is a front view of a connector according to a different embodiment with respect to the preceding figures.
Figure 8:
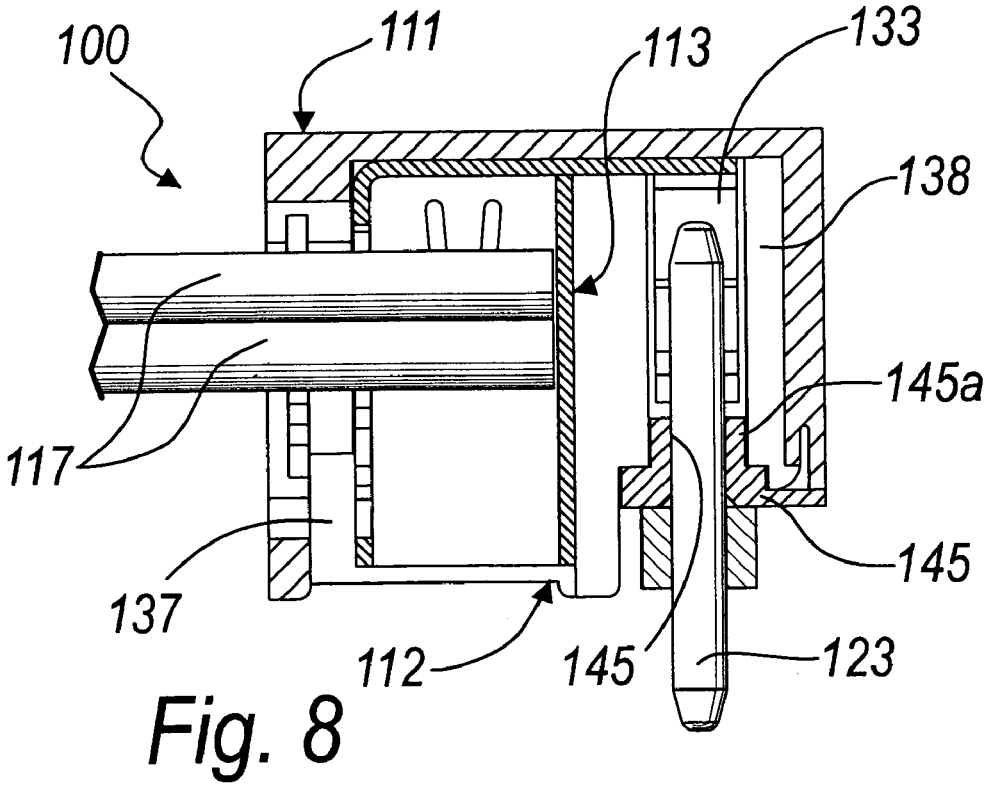
FIG. 8 is a sectional view of the connector of FIG. 7, taken along the line VIII-VIII of FIG. 7.
Figure 9:
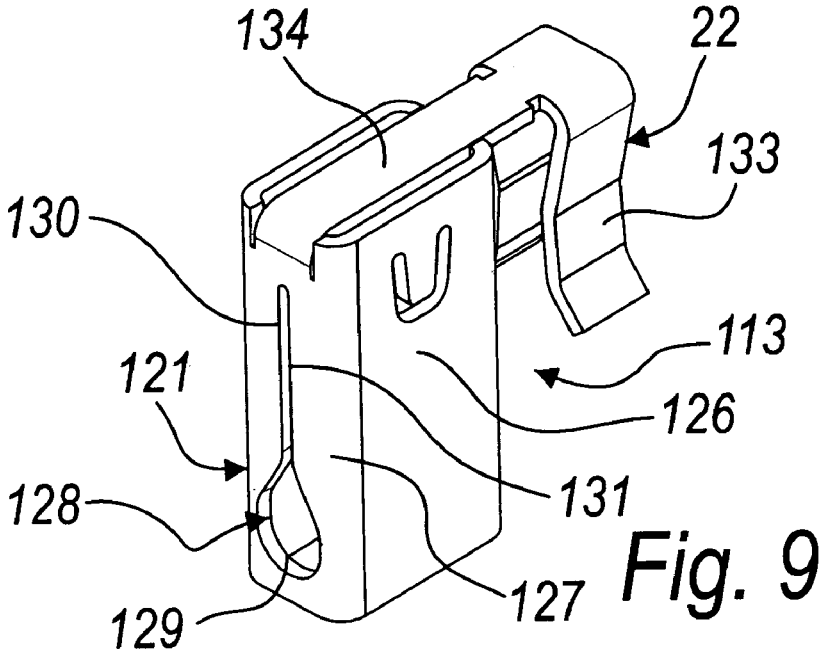
FIG. 9 is a view of the electrical terminal to be used in the connector of FIGS. 7 and 8.
Figure 10:
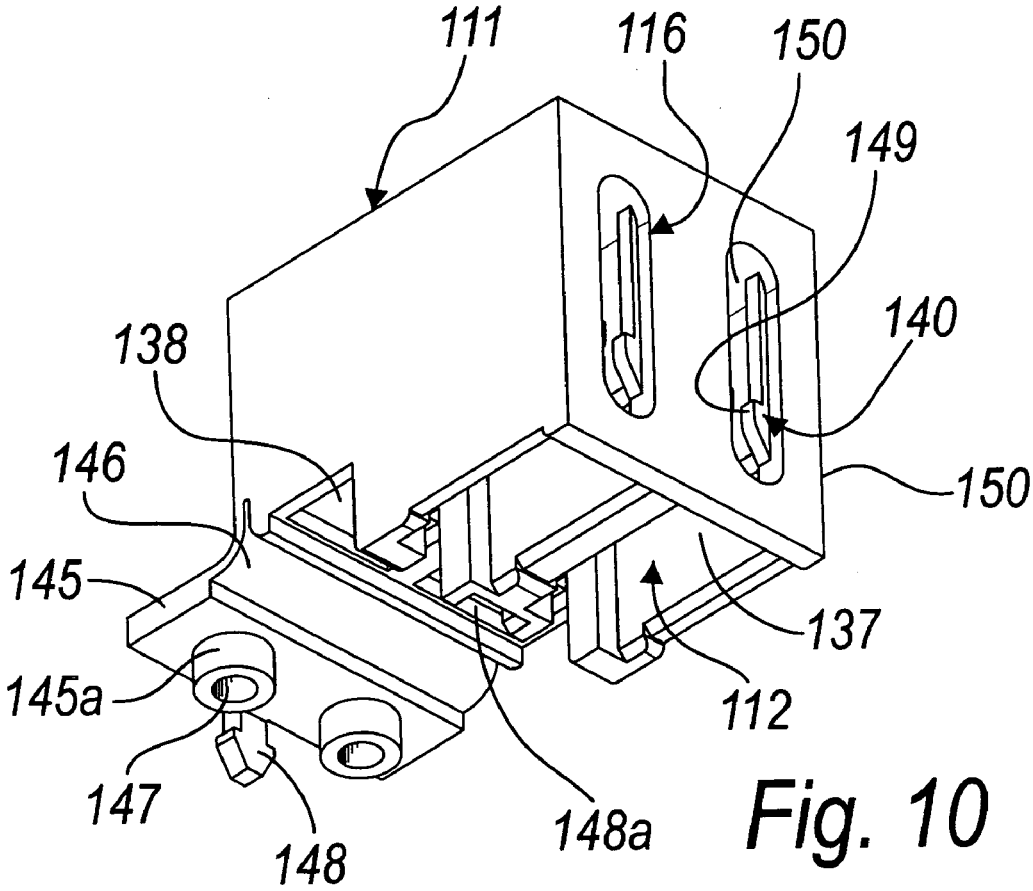
FIG. 10 is a view of the box-like connection shell of the connector of FIGS. 7 and 8.

As shown in FIG. 4, the connectors can be arranged mutually side by side on pins which are spaced with the same spacing, so as to form in practice a multiple-receptacle connector; this is possible since the distance from the axis of the passage 35 between the at least converging wings 33 of the outermost terminals 13 of the connector to the outer face of the closest side wall 42 is equal to half the distance between the axes of the passages 35 of contiguous terminals 13 (which corresponds to half the distance between the axes of the pins 23).

FIGS. 7 to 10 illustrate another embodiment of the connector according to the invention, which is now designated generally by the reference numeral 100.

In this embodiment also, each receptacle 112 of a corresponding electrical terminal 113 is constituted by two parallel seats, respectively a first seat 137 for accommodating the first part 121 of the electrical terminal 113 and a second seat 138 for accommodating the second part 122 of the terminal 113.

In particular, in this embodiment the second seat 138 is closed by a flap 145, which is pivoted to the box-like shell 111 by means of an elastically deformable strap 146 which is monolithic with respect to the box-like shell 111.

The flap 145 has two through entrance holes 147 (one for each receptacle) for the corresponding pin 123; in particular, each through entrance hole 147 is aligned with the space comprised between the wings 133 and is constituted by a cylindrical portion **145*a* which is higher than the flap 145 is thick, thus increasing the stability of the pin 123** that is associated.

The flap 145 engages, when closing, the box-like shell 111 by means of a retention tooth 148 which protrudes at right angles to said flap from the edge of said box-like shell (which lies opposite the edge for pivoting by means of the strap 146); the retention tooth 148 enters a corresponding receptacle **148*a* which is provided on the face of the box-like shell 111 against which the flap 145** is closed.

In this embodiment also, the electrical terminal 113 is provided monolithically by blanking and bending sheet metal and is constituted by two parts: the first part 121, constituted by the laminar body 126, and the second part 122, constituted by the bridge 134 with the wings 133.

This embodiment differs from the preceding one also in that the plate 127 with the through hole 128 constitutes only a single side of the laminar body 126, of course the one that lies adjacent to the transverse access hole 116, while the opposite side is completely closed.

The bridge 134, in this embodiment, is joined to the end of the laminar body 126 that lies further inward with respect to the bottom of the receptacle 112; in particular, it protrudes from the end of the plate 127 toward the opposite side, reaching beyond it. The bridge abuts against the bottom of the second receptacle 112.

The wings 133 protrude in the opposite direction with respect to the direction of insertion of the terminal 113 in the corresponding receptacle 112.

In this embodiment, the abutment 140 formed on the box-like connection shell 111 which delimits, together with the at least partially converging internal edges 131 of the through hole 128 formed in the plate 127, the arrangement of the electrical wires 117, is constituted by a pair of teeth 149, which protrude from the mutually opposite lateral edges 150 of the transverse access hole 116 of the box-like shell 111.

In particular, said teeth protrude transversely to the direction of insertion of the electrical terminal 113 in the box-like shell 111 and divide the transverse access hole 116 into a first part 116*a*, which is aligned with the first portion 129 of the through hole 128 of the electrical terminal 113, and a second part 116*b*, which substantially corresponds to the stripping region of the second portion 130 of the through hole 128.

The teeth 149 are beveled in order to facilitate the passage of the electrical wires 117 from the first part 116*a* to the second part during the assembly step.

As can be seen, the assembly of this embodiment of the connector is different from the one illustrated previously.

In this case, the terminals are inserted in the respective receptacles, making the bridge abut against their bottom.

The wires are inserted within the first part 116*a* of the transverse access hole 116 which is aligned with the first portion 129 of the through hole 128 of the electrical terminal.

Then, either manually or by means of a dedicated tool, said wires are moved toward the second part 116*b*, which corresponds substantially to the stripping region of the second portion 130 of the through hole 128, making them pass (they undergo an elastic deformation) between the teeth 149, which are spaced by an extent which is narrower than the diameter of said wires.

In the second portion 130 of the through hole 128, the wires are stripped so that the copper filaments are in contact with the plate 127.

In practice it has been found that the invention thus described achieves the intended aim and objects; in particular, the present invention provides a connector for transmitting low-voltage signals among electronic units or for transmitting low power levels which is particularly useful in the wiring of domotic networks.

A connector has in fact been provided which has an extremely effective wire locking system, since the wires are locked between the abutment 40, 140 of the box-like shell and the internal stripping edges of the through hole formed in the plates of said terminal; the fact that locking occurs inside the through hole and that said hole is formed completely in the plate causes the mutually opposite portions of the plate that surround the wire laterally not to flex during the insertion of the terminal in the connector, with greater retention and scoring of the terminal on the wire.

Moreover, the use of a terminal in which one part mates reversibly with a pin allows the connector to be easily removable from the electronic board to which it is to be coupled, with obvious advantages in the installations and maintenance of the domotic network in which the connector is used. In known types of connector, the pin is in fact provided monolithically with the terminal and is then soldered to the electronic board.

The fact that the bottom of the terminal receptacles is substantially closed allows to achieve optimum insulation from the outside.

The invention thus conceived is susceptible of numerous modifications and variations, all of which are within the scope of the appended claims; all the details may further be replaced with other technically equivalent elements.

In practice, the materials employed, so long as they are compatible with the specific use, as well as the dimensions, may be any according to requirements and to the state of the art.

The disclosures in Italian Utility Model Application No. PD2005U000100 from which this application claims priority are incorporated herein by reference.

What is claimed is:

1. An electrical connector for transmitting low-voltage signals among electronic units or for transmitting low power levels for wiring domotic networks, comprising: a box connection shell with a connection face, which is shaped like a parallelepiped and forms internally at least one receptacle; a corresponding electrical terminal accomodatable in said at least one receptacle, said at least one receptacle having an opening which is formed on the connection face of said box connection shell and a transverse access hole which is formed on a face thereof which is perpendicular to said connection face, said access hole being adapted for passage therethrough of an end of at least one electrical wire for connection to the electrical terminal accommodated in said at least one receptacle; a connection pin, said electrical terminal being constituted by two parts, of which a first part for fixing to the at least one electrical wire and a second part that is reversible coupleable to said connection pin, said first part being constituted by a laminar body which is folded so as to form a transverse cross-section which has a quadrangular profile; a plate constituting at least one side of said profile and on which a through hole is formed centrally, said through hole being delimited completely within said plate and being constituted by two portions, of which a first portion in which at least one electrical wire is insertable and a second portion for connection to said at least one wire, inserted in said first portion, said second portion opening onto said first portion and having two internal edges thereof which at least partially converge for stripping and contact with said at least one electrical wire, said second part of the electrical terminal being constituted by a bridge and two wings which at least partially converge and protrude from said bridge for connection to one end of said laminar body, said bridge protruding in a direction of insertion of the at least one electrical wire in said through hole, said two wings protruding substantially in the same direction as said plate; a shell abutment formed on said box connection shell for delimiting positioning of said at least one, inserted, electrical wire between said abutment and said converging internal edges of said through hole of the terminal.

2. The electrical connector of claim 1, wherein said electrical terminal is a monolithically formed single body obtained by blanking and bending sheet metal, and is constituted by said two parts, said first part being constituted by said laminar body folded so as to form a transverse cross-section having a quadrangular profile in which two mutually opposite sides are constituted by two of said plates, which are parallel and substantially identical and are arranged so as to face each other correspondingly, said bridge being joined to an end of said laminar body that lies further outward with respect to a bottom of said at least one receptacle of the connection shell in which the laminar body is inserted, a passage being provided on a common base of said wings and being adapted to allow insertion of the pin and consequent locking between said wings.

3. The electrical connector of claim 1, wherein said at least one receptacle for accommodating a corresponding said electrical terminal is constituted by two parallel seats, respectively a first seat for accommodating said first part of said electrical terminal and a second seat for accommodating said second part of the electrical terminal, and by a dividing wall, said first and second seats being divided by said dividing wall, which forms on its own upper edge a bridge abutment for said bridge for connection between said first and second parts of the electrical terminal.

4. The electrical connector of claim 3, wherein said shell abutment formed on said box connecting shell is constituted by an anvil body, which protrudes from the bottom of said first seat toward said opening of the receptacle and is shaped substantially complementarily to an internal space of said first part of said electrical terminal.

5. The electrical terminal of claim 4, wherein said anvil body has a concave head.

6. The electrical connector of claim 1, wherein the first portion of said through hole of said terminal is arranged, upon assembly of the connector, so as to match up with said transverse access hole.

7. The electrical connector of claim 1, wherein said electrical terminal is a monolithically formed single body obtained by blanking and bending sheet metal and is constituted by said two parts, said first part being constituted by said laminar body, folded so as to form a transverse cross-section which has a quadrangular profile in which a single side is constituted by said plate, said bridge being joined to an end of said laminar body that lies further inward with respect to a bottom of said at least one receptacle of the connection shell in which the laminar body is inserted, said wings protruding in the opposite direction with respect to the direction of insertion of the terminal in said at least one receptacle.

8. The electrical connector of claim 7, wherein said at least one receptacle of a corresponding said electrical terminal is constituted by two parallel seats, respectively a first seat for accommodating said first part of said electrical terminal and a second seat for accommodating said second part of the terminal, said second seat being provided with and closed by a flap which is pivoted to the box shell by way of an elastically deformable strap which is monolithic with respect to said box-like shell, said flap having at least one through entrance hole for said connection pin, said through entrance hole being aligned with a space comprised between said wings, said bridge abutting against a bottom of said second seat.

9. The electrical connector of claim 8, wherein said at least one through entrance hole has a cylindrical portion which is higher than said flap is thick.

10. The electrical connector of claim 9, wherein said shell abutment is constituted by at least one tooth, which protrudes from at least one lateral edge of said transverse access hole in a direction which lies transversely to a direction of insertion of said at least one electrical terminal in said box shell, said at least one tooth dividing said transverse access hole into a first part, which is aligned with said first portion of the through hole of said electrical terminal and a second part which substantially corresponds to a stripping region of said second portion of said through hole of said electrical terminal, said at least one tooth being beveled in order to facilitate passage of said at least one electrical wire from said first part to said second part during assembly.

11. The electrical connector of claim 10, comprising two of said teeth, which are arranged on mutually opposite lateral edges of said transverse access hole.

12. The electrical connector of claim 2, wherein a distance from an axis of said passage between said at least partially converging wings of said outermost terminals of the connector to an outer face of a nearest side wall is equal to half a distance between axes of said passages of contiguous terminals, which corresponds to half a distance between axes of said pins.

13. The electrical connector of claim 12, wherein said transverse access hole is provided completely surrounded by a wall in which the hole is provided.

14. The electrical connector of claim 2, wherein a bottom of said at least one receptacle is substantially closed by a closure wall which is monolithic with the rest of said box connection shell.

15. The electrical connector of claim 14, wherein faces of said box connection shell are provided closed, except for said connection face and the perpendicular face on which said transverse access hole is provided.

* * * * *